US007456718B1

(12) United States Patent
Teng et al.

(10) Patent No.: US 7,456,718 B1
(45) Date of Patent: Nov. 25, 2008

(54) WIRE-ARRANGING PIN AND WINDING FRAME AND TRANSFORMER HAVING SAME

(75) Inventors: Ching-Hsien Teng, Taoyuan Hsien (TW); Hsin-Wei Tsai, Taoyuan Hsien (TW); Chun-Yu Hou, Taoyuan Hsien (TW); Tzu-Yang Liu, Taoyuan Hsien (TW); Zhi-Liang Zhang, Taoyuan Hsien (TW); Tsung-Sheng Yeh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/969,586

(22) Filed: Jan. 4, 2008

(30) Foreign Application Priority Data

Oct. 9, 2007 (TW) ..... 96137811 A

(51) Int. Cl.
*H01F 27/29* (2006.01)

(52) U.S. Cl. ..... 336/192

(58) Field of Classification Search ..... 336/65, 336/107, 192, 198, 200, 208, 232
See application file for complete search history.

(56) References Cited

U.S. PATENT DOCUMENTS

| | | | | |
|---|---|---|---|---|
| 5,165,056 | A * | 11/1992 | Chien-heng | 336/65 |
| 5,896,077 | A * | 4/1999 | Cadwallader | 336/192 |
| 6,208,232 | B1 * | 3/2001 | Chen | 336/192 |
| 6,734,774 | B2 * | 5/2004 | Yeh et al. | 336/192 |
| 7,154,365 | B2 * | 12/2006 | Park | 336/198 |
| 2005/0212638 | A1 * | 9/2005 | Selverian et al. | 336/192 |

* cited by examiner

*Primary Examiner*—Tuyen T. Nguyen
(74) *Attorney, Agent, or Firm*—Kirkton & McConkie; Evan R. Witt

(57) ABSTRACT

A wire-arranging pin is mounted on a winding frame for facilitating fixing an outlet part of a winding coil. The winding coil is wound around the winding frame. The wire-arranging pin includes a first connecting part, a main fixing part and a second connecting part. The first connecting part has a first end and a second end, wherein the first end is coupled to the winding frame. The main fixing part is coupled to the second end of the first connecting part and has a first notch. The outlet part of the winding coil penetrates through the first notch to be held by the main fixing part. The second connecting part has a first end coupled to the main fixing part.

20 Claims, 7 Drawing Sheets

WIRE-ARRANGING PIN AND WINDING FRAME AND TRANSFORMER HAVING SAME

FIELD OF THE INVENTION

The present invention relates to a wire-arranging pin, and more particularly to a wire-arranging pin for facilitating fixing the outlet part of the winding coil. The present invention also relates to a winding frame and a transformer having such a wire-arranging pin.

BACKGROUND OF THE INVENTION

A transformer has become an essential electronic component for voltage regulation into required voltages for various kinds of electric appliances. The typical transformer principally includes a winding frame, a magnetic core assembly, a primary winding coil and a secondary winding coil. Generally, each of the primary winding coil and the secondary winding coil is formed of a plurality of single-core wires or a multiple strand wire. In addition, the primary winding coil and the secondary winding coil are wound around the winding section of the winding frame. The primary winding coil and the secondary winding coil interact with the magnetic core assembly to achieve the purpose of voltage regulation. Furthermore, multiple pins are mounted on the winding frame. The outlet parts of the primary winding coil and the secondary winding coil are soldered on the pins. Moreover, the pins may be bonded onto corresponding contact portions of a circuit board such that the transformer is fixed on the circuit board.

Referring to FIG. 1, a schematic perspective view of a conventional transformer is illustrated. The transformer 10 of FIG. 1 principally includes an enclosure 11, a winding frame 12, a magnetic core assembly 13, a primary winding coil 14 and a secondary winding coil 15. The winding frame 12 is detachably arranged within the enclosure 11. The arrangement of the winding frame 12 and the enclosure 11 may increase isolation and creepage distance of the transformer 10. The primary winding coil 14 and the secondary winding coil 15 are wound around the winding section of the winding frame 12. Each of the primary winding coil 14 and the secondary winding coil 15 is formed of a plurality of single-core wires. The magnetic core assembly 13 is partially embedded into a channel (not shown) of the winding frame 12. The primary winding coil 14 and the secondary winding coil 15 interact with the magnetic core assembly 13 to achieve the purpose of voltage regulation.

FIG. 2 is a schematic perspective view of the winding frame shown in FIG. 1. Please refer to FIG. 2 and also FIG. 1. The winding frame 12 includes a winding section 120, two base plates 121, 122, multiple pins 123 and multiple partition plates 124. The base plates 121 and 122 are disposed on opposite sides of the bottom of the winding frame 12. Each pin 123 is substantially a conductive stick. The outlet parts 14*a* of the primary winding coil 14 and the outlet parts 15*a* of the secondary winding coil 15 are soldered on some of the pins 123. In addition, every partition plate 124 is arranged between every two adjacent pins 123.

Although the conventional transformer 10 may achieve the purpose of voltage regulation, there are still some drawbacks. For example, since the outlet part 15*a* of the secondary winding coil 15 is soldered on a specified soldering site of a corresponding pin 123, the contact area between the outlet part 15*a* and the pin 123 is usually insufficient. Since the secondary winding coil 15 is formed of a plurality of single-core wires, these single-core wires are readily scattered at the outlet part 15*a* and it is difficult to arrange the wires. If the soldering site is higher than a tip portion 124*a* of the adjacent partition plate 124 with respective to a surface of the winding frame 12, the soldering site become hindrance from inserting the pin 123 into corresponding conductive hole (not shown) of the circuit board. In addition, even if the outlet part 15*a* of the secondary winding coil 15 is soldered on the pin 123, some of the single-core wires at the outlet part 15*a* are possibly separated from each other. Since the secondary winding coil 15 is a high-voltage coil and the contact area between the outlet part 15*a* and the pin 123 is usually insufficient, the heat generated from the transformer 10 during operation is not easily dissipated away. The elevated operating temperature may result in reduced efficiency of the transformer 10.

Therefore, there is a need of developing an improved transformer for obviating the drawbacks encountered by the prior art.

SUMMARY OF THE INVENTION

It is an object of the present invention to provide a wire-arranging pin for facilitating fixing the outlet part of the winding coil, thereby enhancing soldering performance and increasing contact area between the outlet part of the winding coil and the pin.

Another object of the present invention provides a winding frame and a transformer having such a wire-arranging pin, thereby enhancing heat-dissipating efficiency.

In accordance with an aspect of the present invention, there is provided a wire-arranging pin mounted on a winding frame for facilitating fixing an outlet part of a winding coil. The winding coil is wound around the winding frame. The wire-arranging pin includes a first connecting part, a main fixing part and a second connecting part. The first connecting part has a first end and a second end, wherein the first end is coupled to the winding frame. The main fixing part is coupled to the second end of the first connecting part and has a first notch. The outlet part of the winding coil penetrates through the first notch to be held by the main fixing part. The second connecting part has a first end coupled to the main fixing part.

In accordance with another aspect of the present invention, there is provided a winding frame for winding at least one winding coil thereon. The winding frame includes a frame body, two side plates, a plurality of ordinary pins and a plurality of wire-arranging pins. The frame body includes at least one winding section for winding the at least one winding coil thereon. The two side plates are disposed on opposite sides of a bottom of the frame body. The ordinary pins are mounted on at least one of the two side plates. The wire-arranging pins are mounted on one of the two side plates. Each wire-arranging pin includes a first connecting part, a main fixing part and a second connecting part. The first connecting part has a first end and a second end, wherein the first end is coupled to the winding frame. The main fixing part is coupled to the second end of the first connecting part and has a first notch. The outlet part of the winding coil penetrates through the first notch to be held by the main fixing part. The second connecting part has a first end coupled to the main fixing part.

In accordance with another aspect of the present invention, there is provided a transformer. The transformer includes a primary winding coil and at least one secondary winding coil, a winding frame and a magnetic core assembly. The winding frame includes a frame body, two side plates, a plurality of ordinary pins and a plurality of wire-arranging pins. The frame body includes at least one winding section for winding the primary winding coil and the secondary winding coil thereon. The two side plates are disposed on opposite sides of a bottom of the frame body. The ordinary pins are mounted on at least one of the two side plates for fixing multiple outlet parts of the primary winding coil thereon. The wire-arranging pins are mounted on one of the two side plates for fixing multiple outlet parts of the secondary winding coil thereon. Each wire-arranging pin includes a first connecting part having a first end coupled to the frame body of the winding frame and a second end, a main fixing part coupled to the second end of the first connecting part and a second connecting part having a first end coupled to the main fixing part. The main fixing part has a first notch. The outlet part of the winding coil penetrates through the first notch to be held by the main fixing part. An outlet part of the secondary winding coil and a corresponding wire-arranging pin are bonded together via soldering material to be cooperatively formed as a winding pin. The magnetic core assembly is partially embedded into the winding frame.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
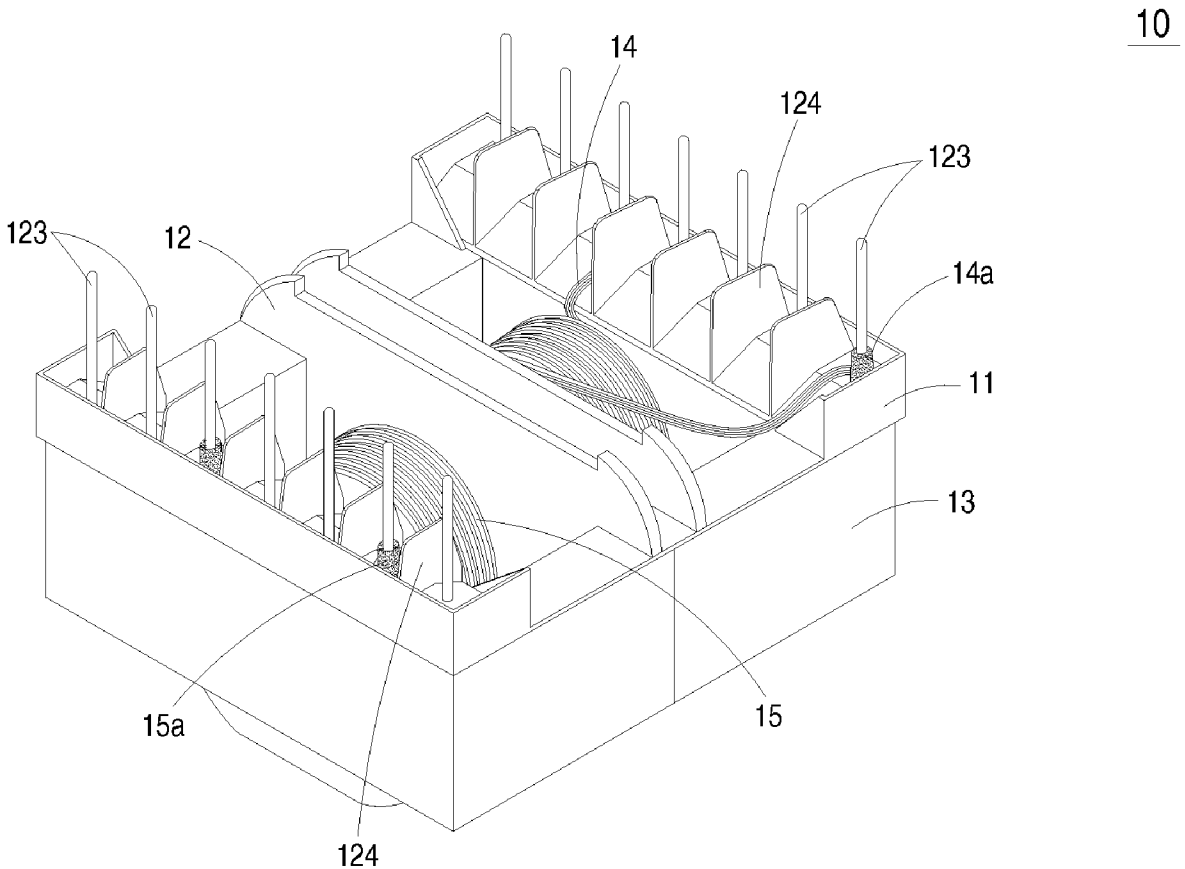
Fig. 1 Prior Art
FIG. 1 is a schematic perspective view of a conventional transformer.
Figure 2:
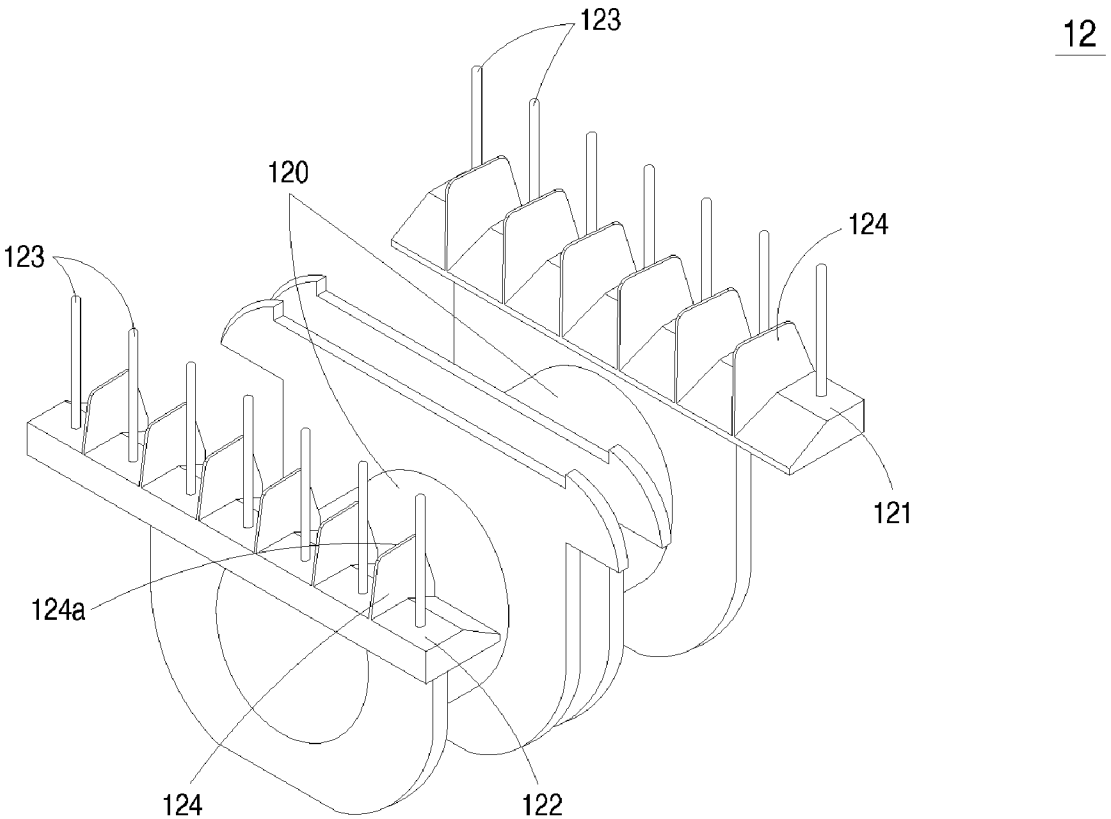
Fig. 2 Prior Art
FIG. 2 is a schematic perspective view of the winding frame shown in FIG. 1.
Figure 3:
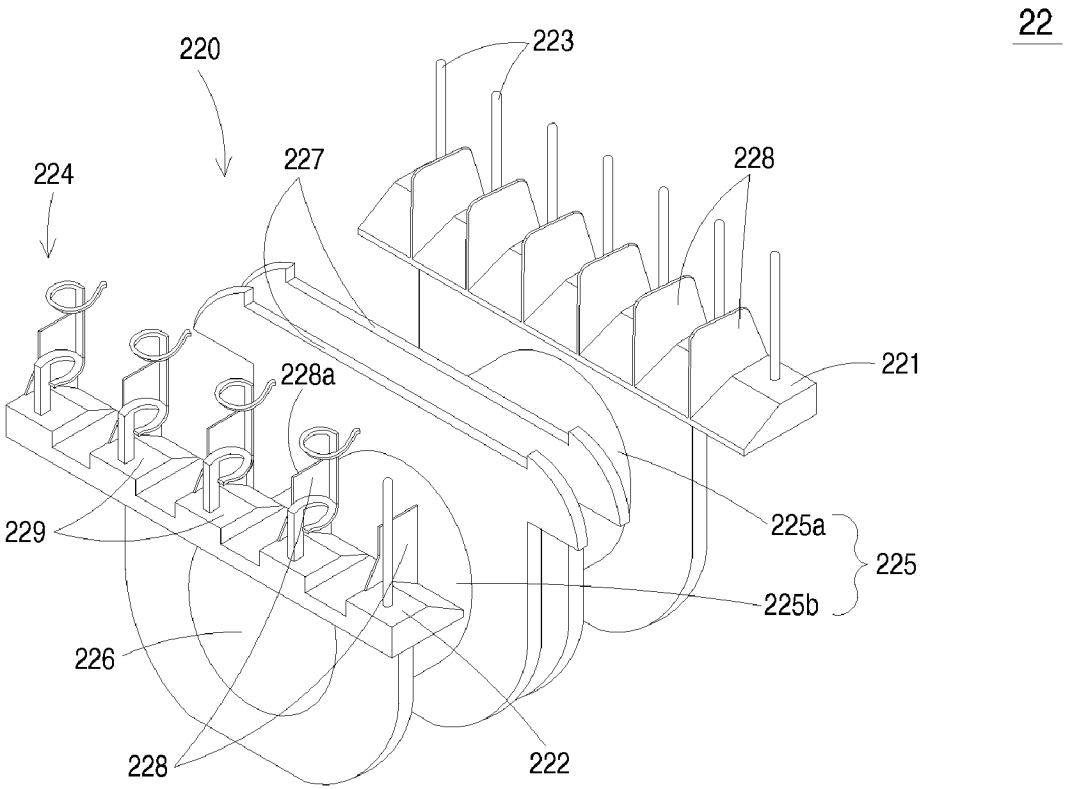
FIG. 3 is a schematic perspective view of a winding frame with wire-arranging pins according to a preferred embodiment of the present invention.

Referring to FIG. 3, a schematic perspective view of a winding frame with wire-arranging pins according to a preferred embodiment of the present invention is illustrated. As shown in FIG. 3, the winding frame 22 principally includes a frame body 220, a first side plate 221, a second side plate 222, multiple ordinary pins 223 and multiple wire-arranging pins 224. The frame body 220 has one or more winding regions 225 and a channel 226. The first side plate 221 and the second side plate 222 are disposed on opposite sides of the bottom of the winding frame 22. The ordinary pins 223 are mounted on at least one of the first side plate 221. Each ordinary pin 223 is substantially a conductive stick. In addition, the wire-arranging pins 224 are mounted on at least one of the first side plate 221 and the second side plate 222. In this embodiment, the ordinary pins 223 and the wire-arranging pins 224 are disposed on the first side plate 221 and the second side plate 222, respectively.

In some embodiments, the winding regions 225 include a first winding region 225*a* and a second winding region 225*b*. The first winding region 225*a* and the second winding region 225*b* are separated from each other by at least one division plate 227. The frame body 220 further includes a plurality of partition plates 228 and a plurality of pin pedestals 229. Every partition plate 228 is arranged between every two adjacent pins 223 or 224. The pin pedestals 229 are also disposed on the second side plate 222 and the wire-arranging pins 224 are disposed on respective pin pedestals 229.

Figure 4:
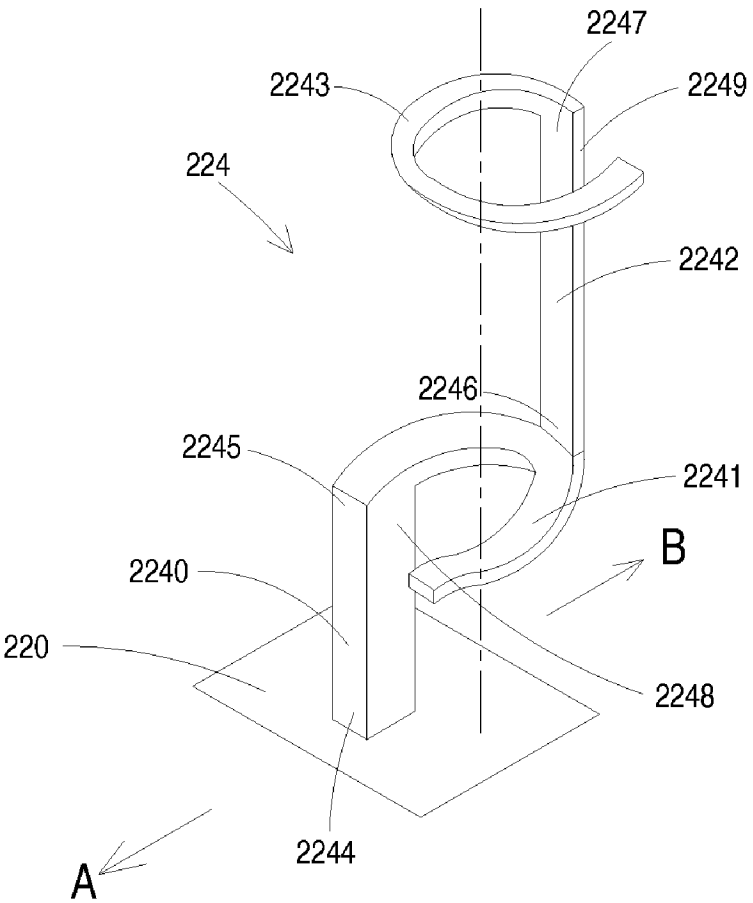
FIG. 4 is a schematic perspective view of a wire-arranging pin shown in FIG. 3.

FIG. 4 is a schematic perspective view of a wire-arranging pin shown in FIG. 3. Please refer to FIG. 4 and also FIG. 3. The wire-arranging pin 224 principally includes a first connecting part 2240, a main fixing part 2241, a second connecting part 2242 and an auxiliary fixing part 2243. The first connecting part 2240 has a first end 2244 and a second end 2245, which are respectively coupled to the frame body 220 and a terminal of the main fixing part 2241. The second connecting part 2242 has a first end 2246 and a second end 2247. The first end 2246 of the second connecting part 2242 is coupled to a middle portion of the main fixing part 2241 such that the first connecting part 2240 and the second connecting part 2242 are staggered with respect to the main fixing part 2241. The second end 2247 of the second connecting part 2242 is coupled to an end of the auxiliary fixing part 2243. In this embodiment, the main fixing part 2241 is substantially a ring-shaped clamping structure with a first notch 2248. The auxiliary fixing part 2243 is substantially another ring-shaped clamping structure with a second notch 2249. The main fixing part 2241 and the auxiliary fixing part 2243 are substantially parallel to the surface of the frame body 220. In this embodiment, the first notch 2248 is open to the direction A and the second notch 2249 is open to the direction B, wherein the direction A is opposite to the direction B. In some embodiments, the distance between the main fixing part 2241 and the surface of the frame body 220 is relatively shorter than the distance between the tip portion 228*a* of the adjacent partition plate 228 and the surface of the frame body 220, as is shown in FIG. 3.

Figure 5:
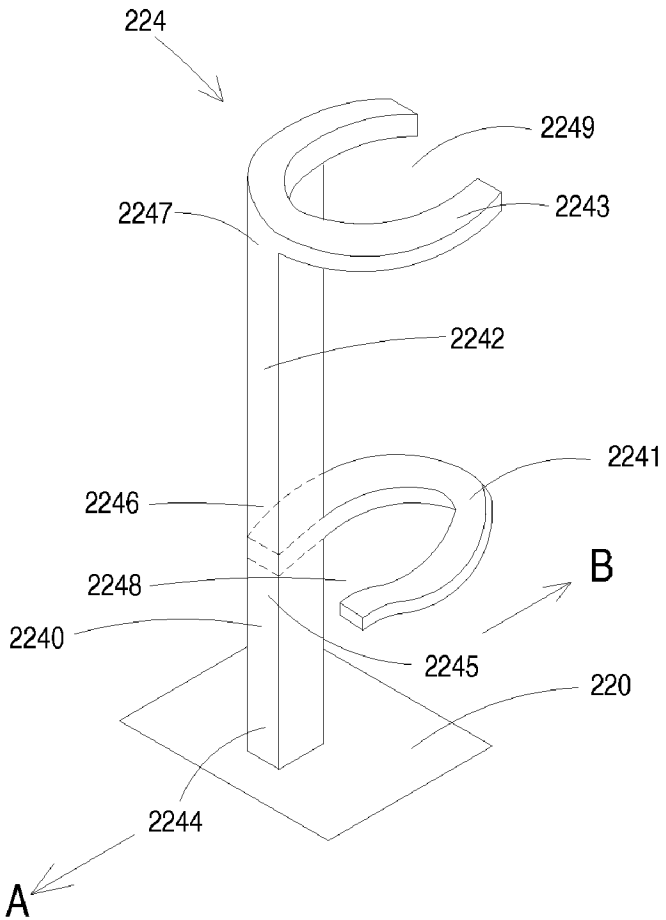
FIG. 5 is a schematic perspective view of another wire-arranging pin.

A further embodiment of a wire-arranging pin is shown in FIG. 5. In this embodiment, the wire-arranging pin 224 also includes a first connecting part 2240, a main fixing part 2241, a second connecting part 2242 and an auxiliary fixing part 2243. The first connecting part 2240 has a first end 2244 and a second end 2245, which are respectively coupled to the frame body 220 and a terminal of the main fixing part 2241. The second connecting part 2242 has a first end 2246 and a second end 2247. The first end 2246 of the second connecting part 2242 is coupled to the terminal of the main fixing part 2241 such that the second connecting part 2242 is aligned with the first connecting part 2240. In addition, the second end 2247 of the second connecting part 2242 is coupled to a middle portion of the auxiliary fixing part 2243. In this embodiment, the main fixing part 2241 is substantially a ring-shaped clamping structure with a first notch 2248. The auxiliary fixing part 2243 is substantially another ring-shaped clamping structure with a second notch 2249. The main fixing part 2241 and the auxiliary fixing part 2243 are substantially parallel to the surface of the frame body 220. In this embodiment, the first notch 2248 is open to the direction A and the second notch 2249 is open to the direction B, wherein the direction A is opposite to the direction B.

Figure 6:
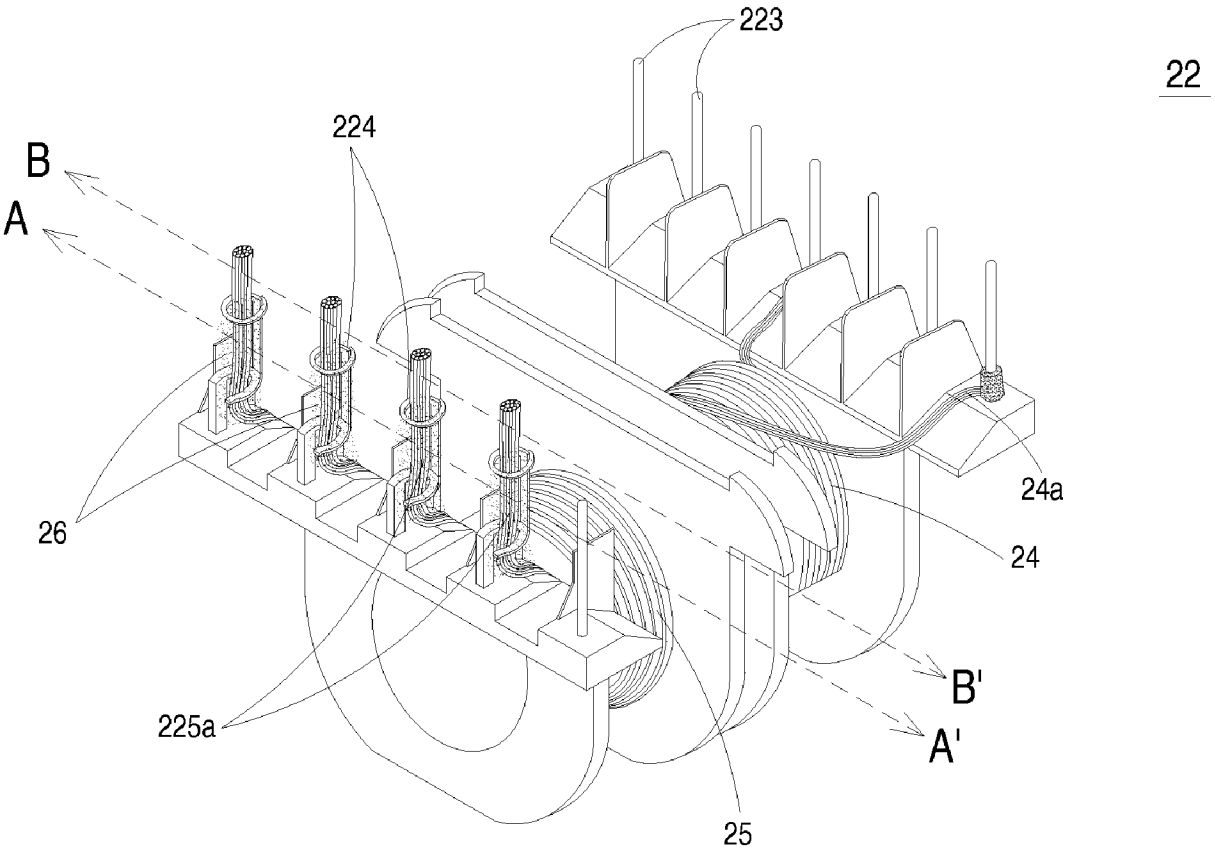
FIG. 6 is a schematic perspective view illustrating a winding frame of FIG. 3, which is wound by a primary winding coil and a secondary winding coil.

FIG. 6 is a schematic perspective view illustrating a winding frame of FIG. 3, which is wound by a primary winding coil and a secondary winding coil. Please refer to FIGS. 3, 4 and 6. Each of the primary winding coil 24 and the secondary winding coil 25 is formed of a plurality of single-core wires or a multiple strand wire. The primary winding coil 24 is wound around the first winding section 225*a*. The secondary winding coil 25 is wound around the second winding section 225*b*. The outlet parts 24*a* of the primary winding coil 24 are directly soldered on corresponding ordinary pins 223. The outlet parts 25*a* of the secondary winding coil 25 are firstly extended above the pin pedestals 229 and then held by the main fixing parts 2241 and the auxiliary fixing parts 2243 of corresponding wire-arranging pins 224. After the soldering material is coated on the wire-arranging pins 224 and the outlet parts 25*a* of the secondary winding coil 25, the outlet parts 25*a* of the secondary winding coil 25 are securely fixed on the wire-arranging pins 224. Meanwhile, the single-core wires at the outlet part 25*a* will not be separated from each other. Next, the auxiliary fixing parts 2243 and the excess outlet parts 25*a* are cut off along the line AA' or otherwise only the excess outlet parts 25*a* are cut off along the line BB'. As a consequence, the outlet parts 25*a* and the wire-arranging pins 224 can be mounted on corresponding contact portions of a circuit board.

Figure 7:
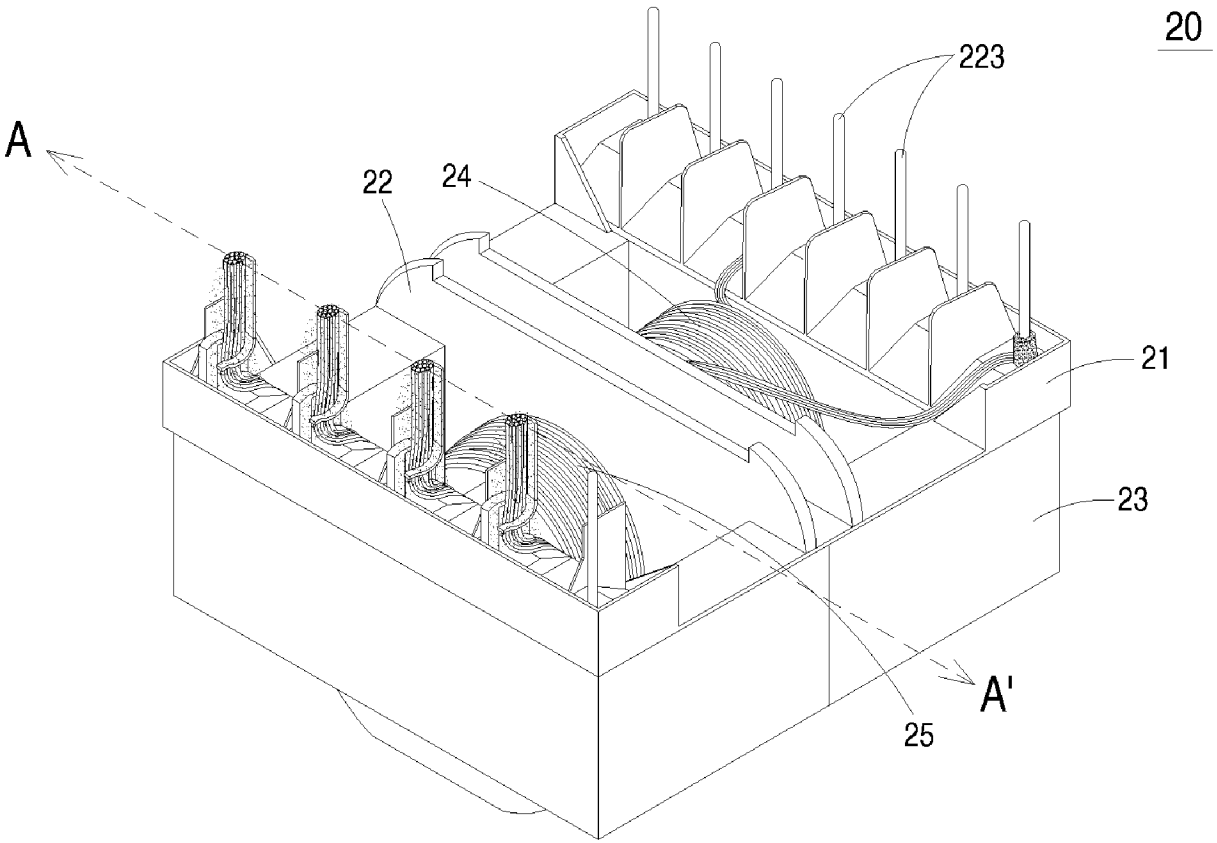
FIG. 7 is a schematic perspective view of a transformer fabricated from the winding frame having wire-arranging pins as shown in FIG. 6.

FIG. 7 is a schematic perspective view of a transformer fabricated from the winding frame having wire-arranging pins as shown in FIG. 6. The transformer 20 of FIG. 7 principally includes an enclosure 21, the winding frame 22 having wire-arranging pins 224, a magnetic core assembly 23, the primary winding coil 24 and the secondary winding coil 25. The winding frame 22 is detachably arranged within the enclosure 21. The arrangement of the winding frame 22 and the enclosure 21 may increase isolation and creepage distance of the transformer 20. The primary winding coil 24 and the secondary winding coil 25 are respectively wound around the winding sections 225*a* and 225*b* of the winding frame 22. The mechanism of winding the primary winding coil 24 and the secondary winding coil 25 around the winding frame 22 is identical to that shown in FIG. 6, and is not redundantly described herein. Therefore, the magnetic core assembly 23 is partially embedded into a channel (not shown) of the winding frame 22. The primary winding coil 24 and the secondary winding coil 25 interact with the magnetic core assembly 23 to achieve the purpose of voltage regulation.

Please refer to FIGS. 3, 4, 6 and 7 again. Hereinafter, a process of fabricating the transformer 20 by using the winding frame 20 of the present invention will be illustrated as follows. First of all, the enclosure 21, the winding frame 22 having wire-arranging pins 224, the magnetic core assembly 23, the primary winding coil 24 and the secondary winding coil 25 are provided. Each of the primary winding coil 24 and the secondary winding coil 25 is formed of a plurality of single-core wires or a multiple strand wire. Then, the primary winding coil 24 and the secondary winding coil 25 are respectively wound around the winding sections 225*a* and 225*b* of the winding frame 22. The outlet parts 24*a* of the primary winding coil 24 are soldered on corresponding ordinary pins 223. The outlet parts 25*a* of the secondary winding coil 25 are held by the main fixing parts 2241 and the auxiliary fixing parts 2243 of corresponding wire-arranging pins 224. After the soldering material is coated on the wire-arranging pins 224 and the outlet parts 25*a* of the secondary winding coil 25, the outlet parts 25*a* of the secondary winding coil 25 are securely fixed on the wire-arranging pins 224. Meanwhile, the single-core wires at the outlet part 25*a* will not be separated from each other. Next, the auxiliary fixing parts 2243 and the excess outlet parts 25*a* are cut off along the line AA' or otherwise only the excess outlet parts 25*a* are cut off along the line BB'. As a consequence, the outlet parts 25*a* and the wire-arranging pins 224 are cooperatively formed as winding pins, which can be mounted on corresponding contact portions (e.g. conductive holes) of a circuit board. Next, the winding frame which has been wound by the primary winding coil 24 and a secondary winding coil 25 is disposed within the enclosure 21. Afterwards, the magnetic core assembly 23 is partially embedded into the enclosure 21 and the winding frame 22 and then fixed by an adhesive tape (not shown), thereby assembling the transformer 20.

From the above embodiment, the wire-arranging pin of the present invention may facilitate fixing the outlet parts of the winding coils so as to increase soldering performance. Since the outlet parts of the winding coil and the wire-arranging pins are cooperatively formed as winding pins, the winding pins may be directly inserted into corresponding conductive holes (not shown) of the circuit board without being hindered by the soldering sites. Moreover, since the contact area between the outlet part of the winding coil and a corresponding wire-arranging pin is increased, the heat-dissipating efficiency and the operating efficiency of the transformer are both enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wire-arranging pin mounted on a winding frame for facilitating fixing an outlet part of a winding coil, said winding coil being wound around said winding frame, said wire-arranging pin comprising:

a first connecting part having a first end and a second end, said first end being coupled to said winding frame;

a main fixing part coupled to said second end of said first connecting part and having a first notch, wherein said outlet part of said winding coil penetrates through said first notch to be held by said main fixing part; and a second connecting part having a first end coupled to said main fixing part.

2. The wire-arranging pin according to claim 1 further including an auxiliary fixing part, which is coupled to a second end of said second connecting part, wherein said auxiliary fixing part has a second notch, and said outlet part of said winding coil penetrates through said second notch to be held by said auxiliary fixing part.

3. The wire-arranging pin according to claim 2 wherein said main fixing part is substantially a ring-shaped clamping structure with said first notch, said auxiliary fixing part is another ring-shaped clamping structure with said second notch, and said first notch and said second notch are open to opposite directions.

4. The wire-arranging pin according to claim 2 wherein said second end of said first connecting part is coupled to a terminal of said main fixing part, said first end of said second connecting part is coupled to a middle portion of said main fixing part and a second end of said second connecting part is coupled to a terminal of said auxiliary fixing part such that said first connecting part and said second connecting part are staggered with respect to said main fixing part.

5. The wire-arranging pin according to claim 2 wherein said second end of said first connecting part is coupled to a terminal of said main fixing part, said first end of said second connecting part is coupled to said terminal of said main fixing part and a second end of said second connecting part is coupled to a middle portion of said auxiliary fixing part such that said first connecting part is aligned with said second connecting part.

6. A winding frame for winding at least one winding coil thereon, said winding frame comprising:

a frame body including at least one winding section for winding said at least one winding coil thereon;

two side plates disposed on opposite sides of a bottom of said frame body;

a plurality of ordinary pins mounted on at least one of said two side plates; and a plurality of wire-arranging pins mounted on one of said two side plates, each said wire-arranging pin including:

a first connecting part having a first end and a second end, said first end being coupled to said frame body;

a main fixing part coupled to said second end of said first connecting part and having a first notch, wherein said outlet part of said winding coil penetrates through said first notch to be held by said main fixing part; and a second connecting part having a first end coupled to said main fixing part.

7. The winding frame according to claim 6 wherein each said wire-arranging pin further includes an auxiliary fixing part, which is coupled to a second end of said second connecting part, wherein said auxiliary fixing part has a second notch, and said outlet part of said winding coil penetrates through said second notch to be held by said auxiliary fixing part.

8. The winding frame according to claim 7 wherein said main fixing part is substantially a ring-shaped clamping structure with said first notch, said auxiliary fixing part is another ring-shaped clamping structure with said second notch, and said first notch and said second notch are open to opposite directions.

9. The winding frame according to claim 7 wherein said second end of said first connecting part is coupled to a terminal of said main fixing part, said first end of said second connecting part is coupled to a middle portion of said main fixing part and a second end of said second connecting part is coupled to a terminal of said auxiliary fixing part such that said first connecting part and said second connecting part are staggered with respect to said main fixing part.

10. The winding frame according to claim 7 wherein said second end of said first connecting part is coupled to a terminal of said main fixing part, said first end of said second connecting part is coupled to said terminal of said main fixing part and a second end of said second connecting part is coupled to a middle portion of said auxiliary fixing part such that said first connecting part is aligned with said second connecting part.

11. The winding frame according to claim 6 further including a plurality of partition plates, which are disposed on said two side plates, for separating adjacent ordinary pins and separating adjacent wire-arranging pins.

12. The winding frame according to claim 11 wherein the distance between said main fixing part of each wire-arranging pin and said frame body is shorter than the distance between a tip portion of said partition plate and said frame body.

13. A transformer comprising:

a primary winding coil and at least one secondary winding coil;

a winding frame including a frame body, two side plates, a plurality of ordinary pins and a plurality of wire-arranging pins, wherein said frame body includes at least one winding section for winding said primary winding coil and said secondary winding coil thereon, said two side plates are disposed on opposite sides of a bottom of said frame body, said ordinary pins are mounted on at least one of said two side plates for fixing multiple outlet parts of said primary winding coil thereon, and said wire-arranging pins are mounted on one of said two side plates for fixing multiple outlet parts of said secondary winding coil thereon, wherein each said wire-arranging pin includes a first connecting part having a first end coupled to said frame body of said winding frame and a second end, a main fixing part coupled to said second end of said first connecting part and a second connecting part having a first end coupled to said main fixing part, wherein said main fixing part has a first notch, said outlet part of said secondary winding coil penetrates through said first notch to be held by said main fixing part, and an outlet part of said secondary winding coil and a corresponding wire-arranging pin are bonded together via soldering material to be cooperatively formed as a winding pin; and a magnetic core assembly partially embedded into said winding frame.

14. The transformer according to claim 13 wherein each of said primary winding coil and said secondary winding coil is formed of a plurality of single-core wires.

15. The transformer according to claim 13 wherein each said wire-arranging pin further includes an auxiliary fixing part, which is coupled to a second end of said second connecting part, wherein said auxiliary fixing part has a second notch, and said outlet part of said winding coil penetrates through said second notch to be held by said auxiliary fixing part.

16. The transformer according to claim 15 wherein said main fixing part is substantially a ring-shaped clamping structure with said first notch, said auxiliary fixing part is another ring-shaped clamping structure with said second notch, and said first notch and said second notch are open to opposite directions.

17. The transformer according to claim 15 wherein said second end of said first connecting part is coupled to a terminal of said main fixing part, said first end of said second connecting part is coupled to a middle portion of said main fixing part and a second end of said second connecting part is coupled to a terminal of said auxiliary fixing part such that said first connecting part and said second connecting part are staggered with respect to said main fixing part.

18. The transformer according to claim 15 wherein said second end of said first connecting part is coupled to a terminal of said main fixing part, said first end of said second connecting part is coupled to said terminal of said main fixing part and a second end of said second connecting part is coupled to a middle portion of said auxiliary fixing part such that said first connecting part is aligned with said second connecting part.

19. The transformer according to claim 13 wherein said winding frame further includes a plurality of partition plates, which are disposed on said two side plates, for separating adjacent ordinary pins and separating adjacent wire-arranging pins.

20. The transformer according to claim 19 wherein the distance between said main fixing part of each said wire-arranging pin and said frame body is shorter than the distance between a tip portion of said partition plate and said frame body.

* * * * *